US009385432B2

(12) United States Patent
Shi et al.

(10) Patent No.: US 9,385,432 B2
(45) Date of Patent: Jul. 5, 2016

(54) WIDEBAND DUAL-POLARIZED RADIATION ELEMENT AND ANTENNA OF SAME

(71) Applicant: TONGYU COMMUNICATION INC., Zhongshan (CN)

(72) Inventors: Lei Shi, Zhongshan (CN); Tieyong Fang, Zhongshan (CN); Zhuofeng Gao, Zhongshan (CN); Mulin Liu, Zhongshan (CN); Hai'ou Ye, Zhongshan (CN)

(73) Assignee: Tongyu Communication Inc., Zhongshan (CN)

( * ) Notice: Subject to any disclaimer, the term of this patent is extended or adjusted under 35 U.S.C. 154(b) by 560 days.

(21) Appl. No.: 13/795,597

(22) Filed: Mar. 12, 2013

(65) Prior Publication Data

US 2013/0187822 A1 Jul. 25, 2013

Related U.S. Application Data

(63) Continuation of application No. PCT/CN2011/073205, filed on Apr. 22, 2011.

(30) Foreign Application Priority Data

Sep. 25, 2010 (CN) ..... 2010 1 0292965

(51) Int. Cl.
*H01Q 9/16* (2006.01)
*H01Q 1/24* (2006.01)
(Continued)

(52) U.S. Cl.
CPC ..... *H01Q 9/16* (2013.01); *H01Q 1/246* (2013.01); *H01Q 9/26* (2013.01); *H01Q 19/106* (2013.01); *H01Q 21/24* (2013.01); *H01Q 21/30* (2013.01)

(58) Field of Classification Search
CPC ..... H01Q 9/16
USPC ..... 343/821
See application file for complete search history.

(56) References Cited

U.S. PATENT DOCUMENTS

| | | | | |
|---|---|---|---|---|
| 6,333,720 | B1 | 12/2001 | Göttl et al. | |
| 2003/0231138 | A1* | 12/2003 | Weinstein | H01Q 1/38 343/795 |
| 2010/0309084 | A1* | 12/2010 | Bu | H01Q 21/08 343/824 |

FOREIGN PATENT DOCUMENTS

| | | |
|---|---|---|
| CN | 1663075 | 8/2005 |
| CN | 1886864 | 12/2006 |

(Continued)

OTHER PUBLICATIONS

International Search Report for PCT/CN2011/073205 dated Jul. 28, 2011, 4 pages.

(Continued)

*Primary Examiner* — Dameon E Levi
*Assistant Examiner* — Andrea Lindgren Baltzell
(74) *Attorney, Agent, or Firm* — Hamre, Schumann, Mueller & Larson, P.C.

(57) ABSTRACT

A wideband dual-polarized radiation element includes two pairs of cross polarized dipoles and baluns which correspondingly feed current to each dipole in a balanced manner. Each dipole includes a pair of unit arms aligned on a top end of the corresponding balun. One end of each unit arm is connected on top of the balun, and the other end of one unit arm is bending inwards to form inward loaded line, and the other unit arm is bending downwards to form downward loaded line. An antenna includes a metal reflector and at least one wideband dual polarized radiation element, which has excellent radiation and polarization performance.

14 Claims, 5 Drawing Sheets

(51) Int. Cl.

| | |
|---|---|
| ***H01Q 9/26*** | (2006.01) |
| ***H01Q 19/10*** | (2006.01) |
| ***H01Q 21/24*** | (2006.01) |
| ***H01Q 21/30*** | (2006.01) |

(56) References Cited

FOREIGN PATENT DOCUMENTS

| | | | |
|---|---|---|---|
| CN | 201134512 | 10/2008 | |
| CN | 101425626 | 5/2009 | |
| CN | WO 2009/056001 A1 * | 5/2009 | ..... H01Q 21/08 |
| CN | 201699136 | 1/2011 | |
| CN | 102013560 | 4/2011 | |
| CN | 201820883 | 5/2011 | |
| KR | 10-2010-0095818 | 9/2010 | |
| WO | 2010/095886 | 8/2010 | |

OTHER PUBLICATIONS

Chinese Office Action for Application No. 201010292965.4 dated Aug. 8, 2012, 4 pages.

* cited by examiner (a)

(b)

WIDEBAND DUAL-POLARIZED RADIATION ELEMENT AND ANTENNA OF SAME

FIELD

The embodiments described herein relate to a base station antenna for mobile communication system, especially to a high performance wideband dual-polarized radiation element and its antenna.

BACKGROUND

At present, under the circumstance of the coexisting 2G and 3G networks, the requirement for antennas which are compatible for 2G and 3G networks are continuously increasing. With the development of communication technology, higher performances of multiple band antennas are also desired.

Basing on the above development tendency, the design that two pairs of cross-polarized dipoles form in the shape of square or circle is commonly applied in the present market. U.S. Pat. No. 6,333,720B1 disclosed an antenna, of which the low band radiation element module included two pairs of cross-polarized dipoles arranged like a dipole square. High band radiation elements are embedded between low band radiation elements to achieve the performance of multiple band antennas.

In the design of U.S. Pat. No. 6,333,720B1, there are some defects in the low band radiation element and its multiple band antennas as following: (1) the linear dipoles have a big dimension of dipole square, which degrades the performance of high band radiation between low band radiation elements. In addition, the coupling between low band radiation elements degrades its electrical performance. (2) The structure of the balun is linear, which makes low band radiation element close to the high band, and the impedance and pattern of the high band radiation elements is effected by the low band radiation elements, which causes lower electrical performance and bad pattern.

Compared with U.S. Pat. No. 6,333,720B1, the design in Chinese Patent published No. CN201134512Y had some improvements. But it still had some defects as following: (1) since the high band radiation element is embodied in low band radiation element to achieve multi-band antenna, the high band radiation element is positioned near the low band balun, which degrades the VSWR (Voltage Standing Wave Ratio) and radiation performance of high band radiation element. (2) Although the design reduced the radiation dimension, all the dipoles at one end are bent downwards, which degrades the performance of high band radiation elements. (3) Different size of dipoles, specially the end thereof being enlarged to expand the operation band, also increases the difficulty of manufacturing and decreases the reliability of the radiation element.

SUMMARY

A main object of the embodiments described herein is to provide a wideband high performance dual-polarized radiation element, which has a simple structure for easily manufacturing, a relatively smaller dimension, and exhibits improved electric and radiation performance.

Another object of the embodiments described herein is to provide a single band or multiple-band antenna, which can reduce cross coupling, and improve electrical and radiation performance.

To obtain the above object, a wideband dual-polarized radiation element including a plurality of dipoles and baluns which feed current to the respective dipoles in a balanced manner is provided. Bottom ends of the baluns are fixed on an annular connector. Each dipole has a pair of unit arms aligned on a top end of the corresponding balun. Each of the pair of the unit arms has one end fixed at a respective side of the top end of the balm, and the other ends of the pair are respectively bent downwards or inwards, thus form a downward loaded line and an inward loaded line.

Preferably, the loaded lines are respectively bent downwards at a right angle with respect to a dipole polygon, and bent inwards to the center of the dipole polygon. Adjacent dipoles have loaded lines parallel. The pair of dipoles are arranged as orthogonal polarization, with the unit arms of dipole linear or fold line and forming a sharp of octagon or hexadecagon. The wideband dual-polarized radiation element is made by integral die-casting.

The baluns are in the shape of arc at a height of 0.2~0.3 of an operation wavelength, and preferably its length is 0.25 of the wavelength of a central frequency. Each balun defines a groove in a lower surface thereof for running feeding cable therein. A hole is defined in one side of top of the balun, and a metallic pillar is set at other side of the top. The feeding cable, which comprises a core wire and outer metallic shielding layer, goes through the hole in the balun from the groove, the core wire thereof and the metallic pillar are respectively welded to either end of a dielectric slice in order to support the slice on the top thereof, and the outer metallic shielding layer is welded in the groove close to the hole. Other end of the feeding cable is welded in the groove close to the annular connector as well. Therefore, the baluns feeds current to the corresponding dipole in balanced manner A wideband antenna comprises a metal reflector and at least one wideband dual-polarized radiation element above. The radiation element is fixed on the metal reflector via fasteners engaging with fixed holes defined in the annular connector. The reflector has a vertical sidewall, and the dipoles of the radiation element are bent downwards near the vertical sidewall.

In another implementation, there are at least two wideband dual-polarized radiation elements installed linearly on the metal reflector.

In the third implementation, there are also several high band radiation elements set on the metal reflector, and at least one is embedded among the wideband dual-polarized radiation element.

Preferably, as the wideband dual-polarized radiation element positioned on the reflector, the dipoles thereof near the vertical sidewall of the reflector are bent downwards, and the dipoles near other radiation element are bent inwards. Namely, the wideband dual-polarized radiation element is arranged on the reflector with the downward loaded lines of the dipoles near the sidewall, and the inward loaded lines adjacent to other radiation element on the reflector.

Benefits of this invention are as follows:

Such design that the dipoles are bent downwards or inwards at ends, and form a shape of octagon or other polygon, greatly reduces the dimension of radiation element on the condition of the same electrical length, in other words, extends the length of radiation current.

Besides, the wideband dual-polarized radiation element of the embodiments described herein is high efficiency, good radiation performance, and can be flexibly applied to single band antenna and multi-band antenna. The integral structure of the radiation element made via die-casting, ensure a simple structure with excellent performance.

The loaded lines which are bent inwards, increase the distance between radiation elements aligned on the reflector, especially increase the distance between the high band radiation elements and the lower band radiation elements, therefore, greatly reduces the interference to the high band radiation element.

The loaded lines, which are bent downwards, compensate the asymmetry of polarization so that it improves greatly the performance of cross polarization discrimination ratio.

Furthermore, the radiation element adopts arc baluns, which simultaneously enhance above feature.

BRIEF DESCRIPTION OF THE DRAWINGS

The embodiments described herein will be explained in more detail in the following text with reference to the drawings in which, in detail.

DETAILED DESCRIPTION

Figure 1:
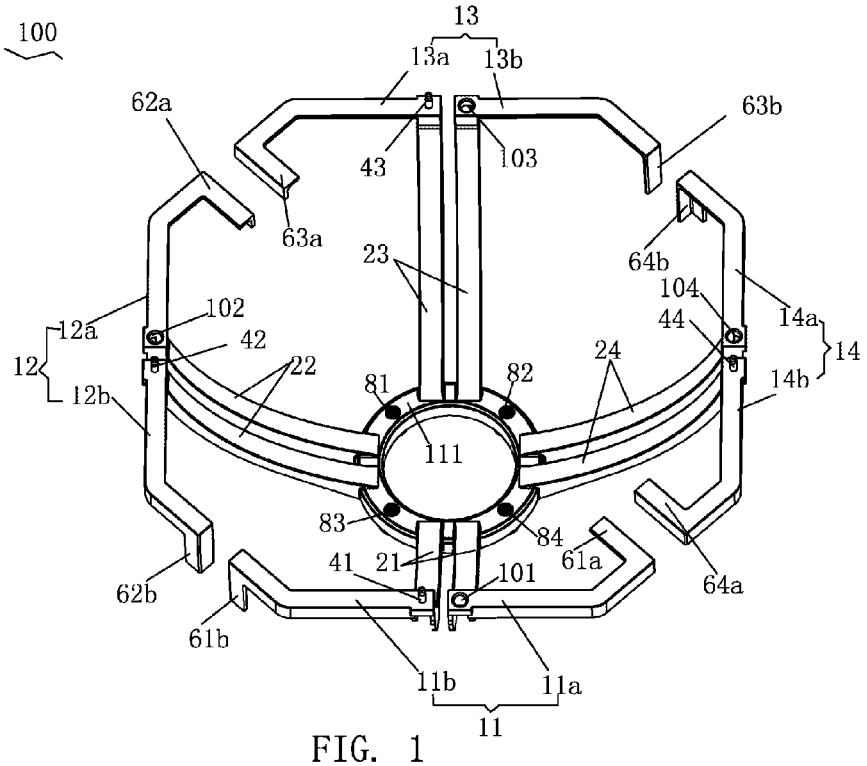
FIG. 1 is a perspective view of a radiation element in accordance with an embodiment.
Figure 2:
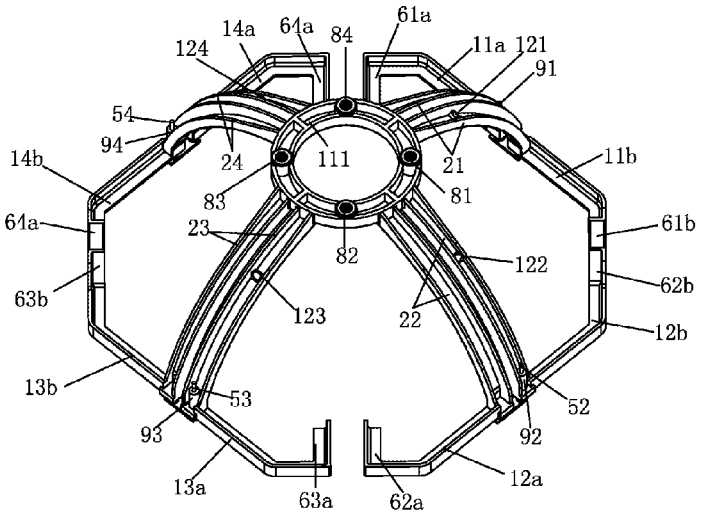
FIG. 2 is a top view of FIG. 1.
Figure 3:
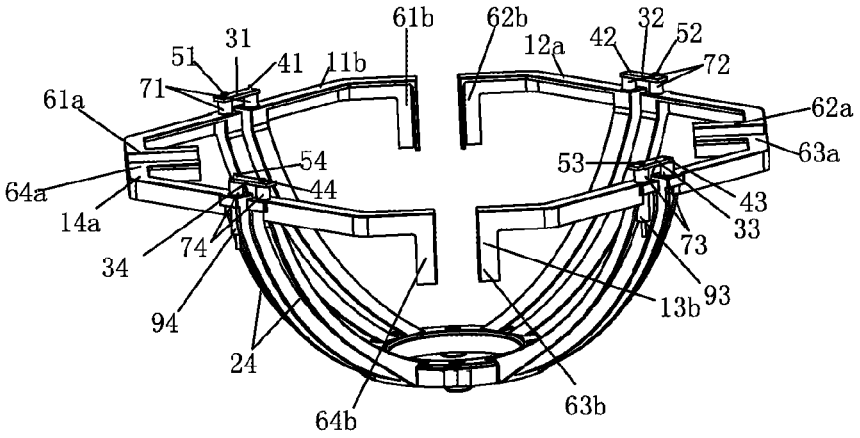
FIG. 3 is a side view of FIG. 1.

Referring to FIGS. 1-3, a high performance wideband dual-polarized radiation element 100, includes a plurality of cross-polarized dipoles 11-14 arranged in a dipole polygon, baluns 21-24 correspondingly feeding current to each dipole in a balanced manner, and an annular connector 111 for fixing the baluns 21-24 at the bottom thereof. In the exemplary embodiment, the radiation element 100 includes two pairs of cross-polarized dipoles 11,12,13,14 arranged in a shape of octagon and aligned on top ends of the baluns 21,22,23,24. The radiation element 100 is made by integral die casting.

In a preferable embodiment, the dipoles 11,12,13,14, have similar structures, and each includes a respective pair of unit arms 11*a* and 11*b*, 12*a* and 12*b*, 13*a* and 13*b*, 14*a* and 14*b*. In each pair, adjacent ends of the unit arms are fixed respectively to two sides of the top end of the corresponding balun, and the other ends are bent downwards or inwards in such way that forms a downward loaded line and inward loaded line 61*a* and 61*b*, 62*a* and 62*b*, 63*a* and 63*b*, or 64*a* and 64*b*. More preferably, the loaded lines 61*b*, 62*b*, 63*b* and 64*b* are respectively bent downwards at a right angle with respect to dipole polygon, and the loaded lines 61*a*, 62*a*, 63*a* and 64*a* are respectively bent inwards to a center of the dipole polygon. Adjacent dipoles have loaded lines parallel to one another.

Taking the dipole 11 as example, it includes a pair of unit arms 11*a* and 11*b* aligned on the top end of the balun 21. The unit arm 11*a* and 11*b* both have one end respectively fixed at two sides of the top end of the balun 21, the other end of unit arm 11*a* bends inwardly, thus forms the loaded line 61*a*, and the other end of unit arm 11*b* bends downwardly to form the loaded line 61*b*. More preferably, the other end of the unit arm 11*a* or 11*b* bends orthogonally downwardly to the dipole octagon to form the downward loaded lines 61*b*, or bends inwardly to the center of the dipole octagon to form the inward loaded lines 61*a*. The configuration of the loaded lines 61*a* and 61*b* can decrease the diameter of the radiation element 100. In other words, the radiating current length of the radiation element 100 is highly extended. Meanwhile, it can minimize the structure of radiation element 100. Furthermore, the inward loaded line 61*a* can decrease the influence from a lower-frequency radiation element (LFRE) to a higher-frequency radiation element (HFRE) in multiple band applications. Therefore, the electrical and radiation performance will be improved.

Similarly, one end of the unit arms 12*a* and 12*b* of the dipole 12 are respectively connected to the top end of the balun 22, and the other ends bend to form downward the loaded line 62*b* and the inward loaded line 62*a*, respectively.

One end of unit arms 13*a* and 13*a* in dipole 13 are connected to the top end of the balun 23, and the other ends bend to form the downward loaded line 63*b* and the inward loaded line 63*a*, respectively.

One end of unit arms 14*a* and 14*a* in dipole 14 are connecting on the top of balun 24, and the other ends bend to form downward loaded line 64*b* and inward loaded line 64*a*. Thus, loaded-lines 61*a* and 64*a* are aligned parallel to one another, 62*a* and 63*a* are parallel aligned, which are all bending inwardly and parallel to a reflector 20 as shown in FIG. 5.

Figure 5:
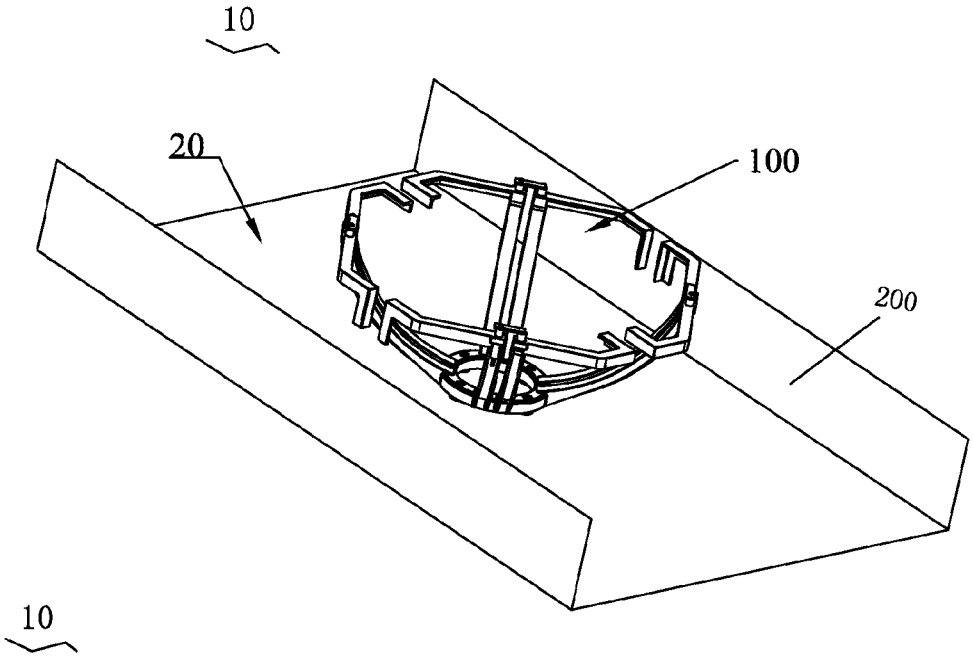
FIG. 5 is a perspective view of a wideband dual-polarized antenna in accordance with an embodiment.

Meanwhile, the downward loaded lines 61*b* and 62*b*, and 63*b* and 64*b* are respectively parallel to each other, and vertical to the reflector 20 as shown in FIG. 5.

The two pairs of dipoles 11-14 forms ±45° polarization, and the dipoles extended in the same direction (e.g., the dipoles 12 and 14; or the dipoles 11 and 13) are spaced at ⅖-⅗ of the operation wavelength away from each other. The bottom ends of the baluns 21-24 are orthogonally fixed on the annular connector 111.

The cross profile of the dipoles 11,12,13,14 can be in the shape of circle, square or polygon, and the shape of circle or polygon will offer better impedance characteristic. To reduce the weight of the radiation element 100, the dipoles 11-14, such as its cross-section in the shape of polygon structure, are configured to have a hollow interior, as a result, manufacturing cost is reduced, and the radiating dimension remains unchanged as well.

Cross profile of the dipoles 11,12,13,14 can also be designed in the shape of "L", "T" or stub line. The shape of stub line can confirm the best impedance characteristic. Considering the difficulty of manufacturing, the dipoles with cross-section in the shape of "L" is more preferable as shown in the drawings.

In a preferable embodiment, the baluns 21-24 are in the shape of arc, and respectively feed current to the dipole 11,12, 13,14 in the radiation element 100 in a balanced manner. The height of each of the baluns 21-24 is ⅕-3⁄10 of the operating wavelength, and preferably is ¼ of a central frequency wavelength. An arc balun expands the distance between a LFRE and a HFRE, which can restrain the influence from the LFRE to the HFRE, and improve the cross-polarization performance thereof in this way.

The baluns 21,22,23,24 have similar structure. The bottom ends of the baluns 21-24 are orthogonally fixed to the annular connector 111, and the top ends of the baluns 21-24 are respectively connected with the dipoles 11,12,13,14. A groove (not labeled) is designed in a lower surface of each balun for accommodating cables and feeding network for an electrical connection and feeding current to their corresponding dipoles.

The balun 21 is illustrated to explain the detail structure of the baluns 21-24 and its feeding network. Referring to FIGS. 1-3 again, the bottom end of the balun 21 is orthogonally connected on the annular connector 111. A feeding cable 91, which includes a core wire 51 and an outer metallic shielding layer (not labeled), is fixed inside of the groove in the lower surface of the balun 21. On the top end of the balun 21, one side thereof defines a hole 101, and the other side sets a metallic pillar 41. The hole 101 communicates to the groove for installing the feeding cable 91. A feeding slice 31 is welded on the top of the metallic pillar 41.

In a specific application, the feeding cable 91 goes through the hole 101, then the core wire 51 thereof is connected with one end of the feeding slice 31, and the other end of the feeding slice 31 is electrically connected with the metallic pillar 41. Thus, electrical connection between the core wire 51 of cable 91 and the unit arm 11*b* of dipole 11 achieves in this way. A pair of dielectric rings 71 is respectively set around outside of the core wire 51 and the metallic pillar 41 so as to support the feeding slice 31.

At a point near the hole 101 in the groove, the outer metallic shielding layer of the feeding cable 91 is welded to the unit arm 11*a*. Moreover, the other end of the cable 91 goes along inside of the groove, and is welded to the balun 21 at a welding point 121 in the groove close to the connector 111, which can avoid the electricity leakage from the cable surface and improve the electric and radiation performance of the radiation element 100.

The baluns 22, 23, 24 and the way to electrically feed to the corresponding dipole 12, 13, 14 are similar to the balun 21. Cables 92, 93, 94 respectively extend along inside of the groove in the lower surface of the corresponding balun, and is respectively welded to the balun at welding points 122, 123, 124 in the groove close to annular connector 111. On the top end of each balun, one side thereof defines a hole 102, 103, or 104, and the other side sets a metallic pillar 42, 43, or 44. The holes 102, 103, and 104 respectively communicates to the groove for installing a feeding cable. A feeding slice 32, 33, 34, is respectively welded on the top of the metallic pillar 42, 43, 44. A pair of dielectric rings 72, 73, 74 respectively sleeve around the core wire 52, 53 or 54 and metallic pillar 42, 43 or 44, thus supports feeding slice 32, 33 or 34 on the top as well. In actual use, the cable 92, 93 or 94 respectively goes through the hole 102, 103, or 104 at one side of the top of balun 22, 23 or 24, its core wire 52, 53 or 54 is connecting with one end of feeding slice 32, 33, or 34, and the metallic pillar 42, 43, or 44 is connecting with the other end of the feeding slice 32, 33 or 34, so as to achieve the electrical connection between the core wire 52, 53 or 54 of feeding cable and one unit arm of the corresponding dipole. At a point close to the hole 102, 103 or 104, the outer metallic shielding layer of the feeding cable 92, 93 or 94 is welded in the groove so as to achieve electrical connection between feeding the cable 92, 93 or 94 and the other unit arm of the corresponding dipole.

The two pairs of dipoles 11-14 of the wideband dual polarized radiation element 100 are cross polarized, and arranged in the form like an octagon or other polygons. The unit arms of the dipoles 11-14 are linear or polygonal lines. The loaded lines of each dipole are respectively bent inwards and downwards. Therefore, at the same electrical wavelength, the dimension of the radiation element 100 is reduced.

Figure 4:
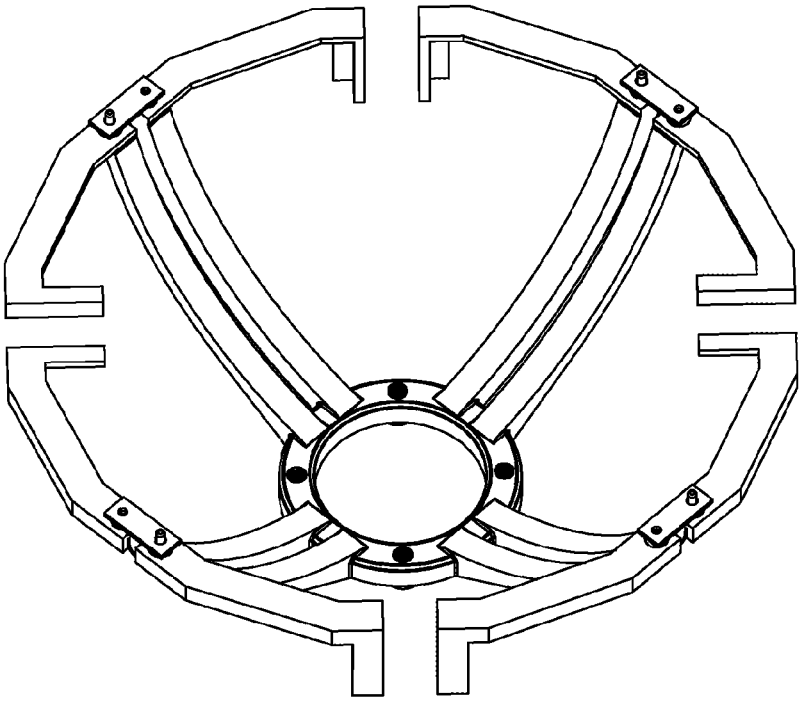
FIG. 4 is a perspective view of the radiation element in accordance with another embodiment.

FIG. 4 illustrates another embodiment of the radiation element 100, where the two pairs of cross-polarized dipoles forms a hexadecagon, which reduces the dimension of the radiation element.

One unit arm of the dipole is inwardly bending, which lessens influence on higher-frequency radiation element caused from the end of the loaded line. The other unit arm is downwardly bending, which offsets the asymmetry of the borders of the dipoles, thus improves the electrical performance.

Each balun is arc, at a height about ⅕-3⁄10 of the operating wavelength, such design can effectively reduces the interaction from different operating frequency bands, which ensures the consistency of electrical performance and a stable structure of the radiation element.

Furthermore, the radiation element 100 is made by integrated casting. It has a simple structure for easily manufacturing, is widely applicable for single band or multiple band antennas with excellent electrical and radiating performance, and mainly applicable for base station antenna for mobile communication.

FIG. 5 shows the radiation element 100 applied in a dual polarized antenna 10 for a single operating band. The radiation element 100 is fixed on the metallic reflector 20. The annular connector 111 defines a plurality of fixing holes 81, 82, 83, 84 therein, via which fastening pieces are inserted, therefore, the radiation element 100 is mounted to the reflector 20. The reflector 20 includes a vertical sidewall 200. According to the direction of the dipoles positioned with respect to the sidewall 200 of the reflector 20, two pairs of the dipoles can form polarization at ±45°, horizontal or vertical polarization.

In the application of single band antenna array, two or more radiation elements 100 are linearly fixed on the metallic reflector 20.

The loaded lines close to the reflector sidewall 200 are downwards bending to offset the asymmetrical borders of the radiation element 100, thus improving the electrical performance of the antenna. Other loaded lines close to radiation element array are inwards bending. Loaded lines are arranged in such way that can increase the distance between radiation elements, namely, it can lessen the interaction therebetween.

Figure 6:
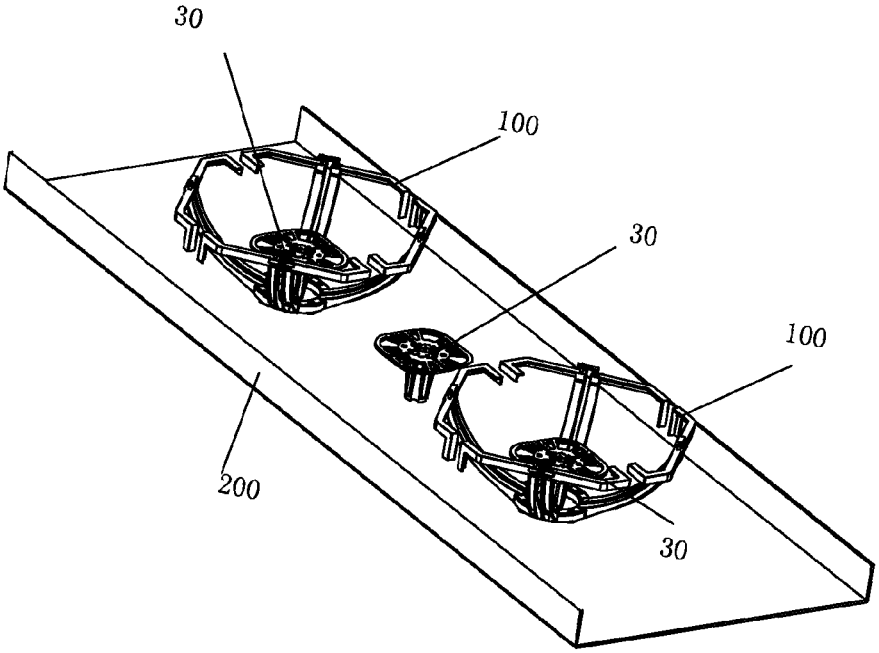
FIG. 6 is a perspective view of a dual-band dual-polarized antenna in accordance with embodiment.

Referring to FIG. 6, in the application of a dual band antenna 10, at least two wideband dual polarized radiation elements 100 are linearly fixed on the metallic reflector 20 as LFREs. Beside, there is a plurality of higher-frequency radiation elements (namely, HFREs) 30 fixed on the reflector 20 as well. At least one HFRE 30 is embedded in the LFREs 100 to form a coaxial array. The loaded lines of the dipoles close to the radiation element array are inward bending, which can increase the distance from the LFRE 100 to the HFRE 30 positioned between two LFREs 100. Therefore, it can lessen the influence caused by LFRE 100 on the HFRE 30.

The invented antenna radiation element 100 is in a shape of octagon, hexadecagon or other polygon. The design lessens the dimension of the LFRE 100 in the application of multiple band antenna, and it can decrease the coupling between radiation elements.

Moreover, loaded-lines in dipole combine with inward bending and downward bending, which can lessen the influence on higher-frequency radiation element 30 caused by the end of the loaded line.

Baluns of the radiation element in the antenna are arc. It is advantageous to diminish the coupling between different operating frequency bands.

The following description is an analytical comparison on radiating and electrical performance in application of a dual band antenna.

In a first exemplary embodiment, the LFRE 100 and HFRE 30 construct a 65° dual band antenna. The impacts on the electrical and radiation performance of antennas for different bending directions of loaded lines are compared.

Two antennas are provided, each including a lower-frequency radiation element (LFRE) module and a higher-frequency radiation element (HFRE) module located within the former. The only difference between the two antennas is that, the first antenna includes the LFRE with loaded lines of dipoles all downward bending, but the second antenna 10 includes the LFRE 100 with loaded lines of dipole respectively downward and inward bending. The simulation data of Section Power Ratio (short for SPR) for the LFRE of the first antenna and the antenna 10 is shown in Table 1. In the application of dual band antenna, the comparison on the simulation data for the HFRE of the first antenna and the antenna 10 is shown in Table 2. Wherein, SPR means section power ratio, HBW means horizontal half-power beam width, CFBR means central-polarization front to back ratio, XPBR means cross-polarization front to back ratio, CPR0 means cross polarization front to back ratio at 0 degree, CPR60 means cross polarization front to back ratio at ±60°, and CPR10 means cross polarization front to back ratio at gain 10 dB.

TABLE 1

Comparison on the simulation data SPR of LFRE

| Operating Frequency | first antenna | Antenna 10 |
|---|---|---|
| 790 | 4.79 | 4.38 |
| 875 | 3.59 | 3.06 |
| 960 | 2.65 | 1.99 |

As shown in table 1 above, the loaded lines of the LFRE 100 that combines inward and downward bending, improve the LFRE's electrical performance.

From the comparison in table 2, it indicates that the LFRE of the first antenna with all loaded lines downward bending degrades the electrical performance of the HFRE thereof. In other words, the LFRE 100 can greatly improve the electrical and radiation performance and the cross polarization discrimination ratio as well.

Figure 7:
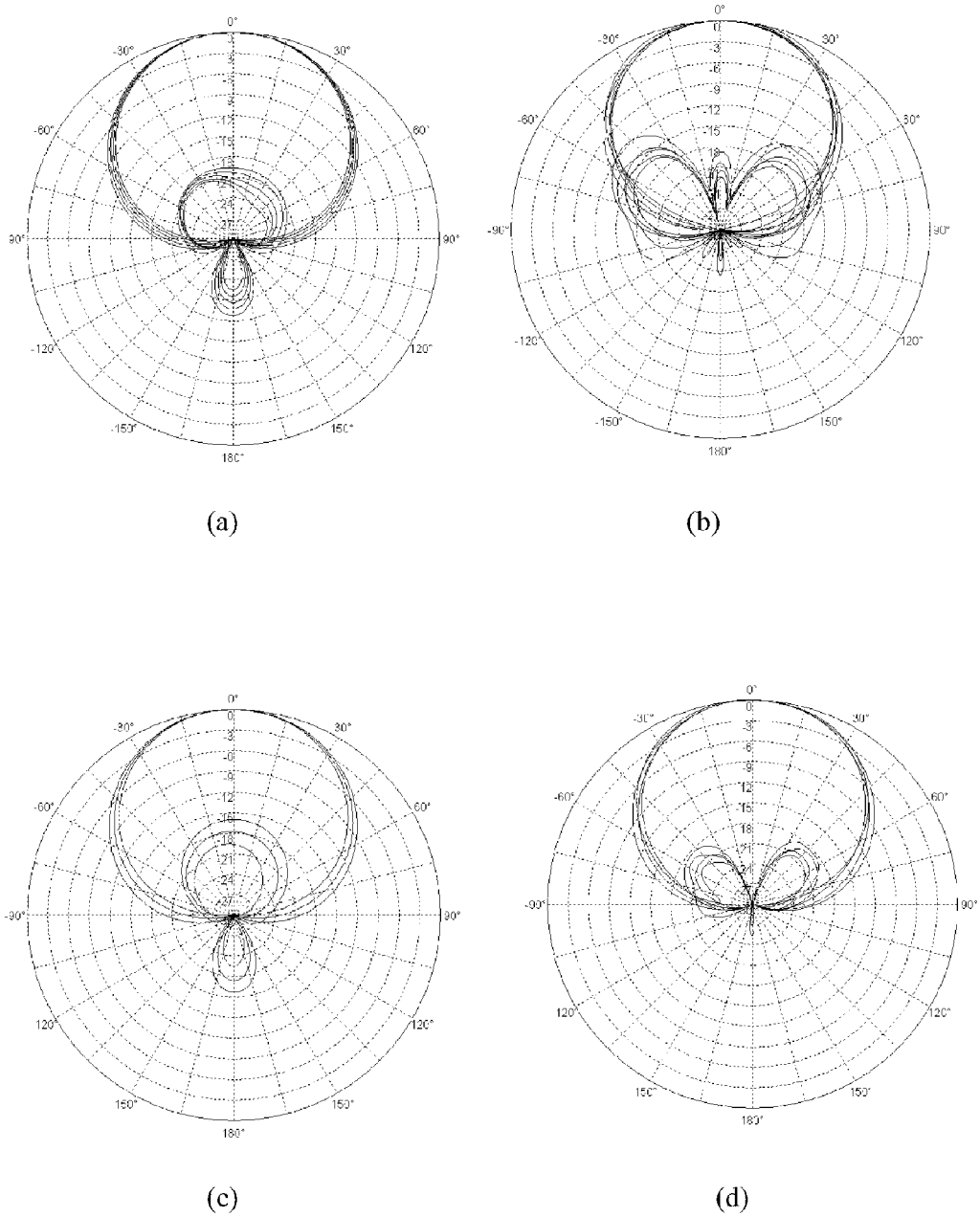
FIG. 7 illustrates H-panel pattern of a dual band antenna in accordance with an exemplary embodiment.

FIG. 7 illustrates H-panel pattern of a dual band antenna, where 7(*a*) shows H panel pattern of LFRE in the first antenna; 7(*b*) shows H panel pattern of HFRE in the first antenna; 7(*c*) shows H panel pattern of LFRE in the second antenna 10, and 7(*d*) shows H panel pattern of HFRE in the second antenna, which show that the loaded lines inward and downward bending in LFRE 100 can optimize the radiation performance of HFRE in the application of dual band antenna 10.

Figure 8:
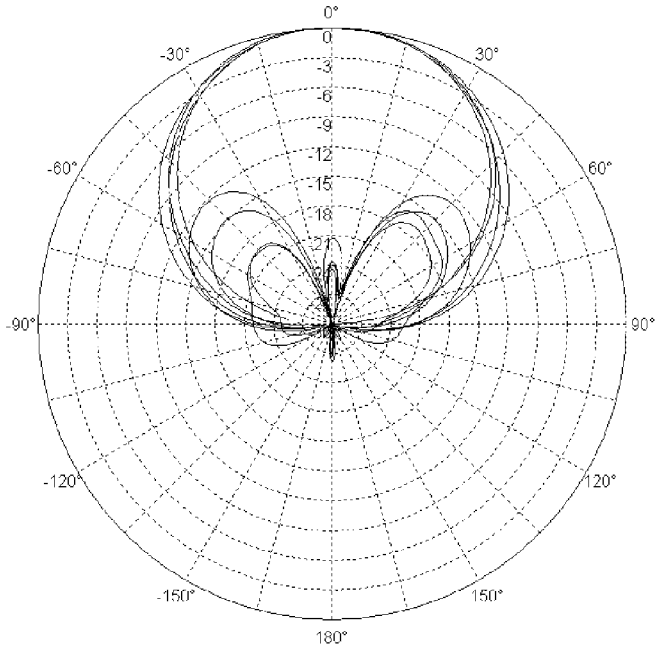
FIG. 8 illustrates another H-panel pattern of a dual-band antenna in another exemplary embodiment.
Figure 8:
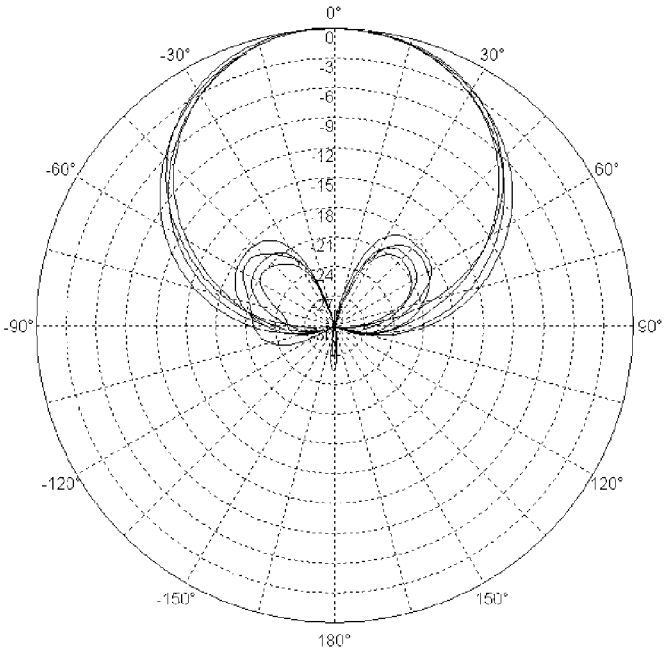

In other exemplary embodiment, a third dual band antenna, which is different to the second antenna 10 in the above first exemplary embodiment, is that the baluns of the LFRE are linear other than arc. The electrical performance of LFRE is shown in Table 3, and its influence to HFRE on electrical and radiation performance is shown in Table 4. FREQ means frequency, and XPBR means front to back cross polarization ratio. FIG. 8 illustrates another H-panel pattern of a dual-band antenna where 8(*a*) indicates the H panel pattern of HFRE of the third antenna; and 8(*b*) indicates the HFRE's H panel pattern of the second antenna 10.

TABLE 3 electrical performance comparison between arc balun and linear balun in LFRE

| | SPR | | CFBR | |
|---|---|---|---|---|
| FREQ | linear balun | arc balun | linear balun | arc balun |
| 790 | 4.79 | 4.38 | 28.16 | 28.23 |
| 875 | 3.37 | 3.06 | 29.18 | 29.39 |
| 960 | 2.25 | 1.99 | 30.34 | 30.49 |

TABLE 2 comparison on the simulation data of HFRE

| | HBW | | CFBR | | CPR0 | | CPR60 | | CPR10 | |
|---|---|---|---|---|---|---|---|---|---|---|
| FREQ | First Antenna | Antenna 10 | First Antenna | Antenna 10 | First Antenna | Antenna 10 | First Antenna | Antenna 10 | First Antenna | Antenna 10 |
| 1710 | 62.63 | 64.16 | 25.42 | 32.59 | 18.84 | 32.55 | 0.47 | 8.48 | 1.66 | 8.48 |
| 1825 | 57.88 | 59.69 | 29.89 | 36.46 | 21.57 | 34.64 | 1.1 | 8.95 | 3.93 | 10.16 |
| 1940 | 57.76 | 57.73 | 34.35 | 40.35 | 22.54 | 34.43 | 1.48 | 9.72 | 5.94 | 11.51 |
| 2055 | 61.05 | 59.88 | 33.84 | 39.55 | 22.33 | 33.11 | −0.18 | 8.07 | 5.02 | 9.84 |
| 2170 | 66.12 | 65.76 | 33.91 | 39.59 | 20.42 | 28.71 | −0.42 | 6.49 | 3.53 | 8.24 |

TABLE 4 electrical performance comparison between arc balun and linear balun in HFRE

| | CFBR | | XPBR | | CPR0 | | CPR60 | | CPR10 | |
|---|---|---|---|---|---|---|---|---|---|---|
| FREQ | arc | linear | arc | linear | arc | linear | arc | linear | arc | linear |
| 1710 | 32.59 | 28.16 | 28.27 | 26.25 | 32.55 | 21.31 | 8.48 | 3.17 | 8.48 | 3.17 |
| 1825 | 36.46 | 32.62 | 29.39 | 28.34 | 34.64 | 23.64 | 8.95 | 4.34 | 10.16 | 5.21 |
| 1940 | 40.35 | 36.6 | 28.61 | 27.97 | 34.43 | 24.57 | 9.72 | 5.84 | 11.51 | 7.89 |
| 2055 | 39.55 | 35.74 | 26.88 | 27.03 | 33.11 | 24.48 | 8.07 | 5.11 | 9.84 | 7.59 |
| 2170 | 39.59 | 33.26 | 25.54 | 26.67 | 28.71 | 24.04 | 6.49 | 4.29 | 8.24 | 6.55 |

From Tables 3-4 and FIG. 8, it is clear that arc balun's impact on HFRE is slight, and XPBR of the arc balun is superior to linear balun. Furthermore, it can ensure the consistency of electrical performance and a stable structure.

In conclusion, the wideband dual-polarized radiation element of the embodiments described herein greatly improves the performance of cross polarization discrimination ratio, function in high efficiency with good radiation performance, and can be flexibly applied to single band antenna and multi-band antenna.

While the invention has been described in conjunction with specific embodiments, it is evident that numerous alternatives, modifications, and variations will be apparent to those skilled in the art in light of the forgoing descriptions. The scope of this invention is defined only by the following claims.

What is claimed is:

1. A wideband dual-polarized radiation element comprising:

a plurality of dipoles arranged in a dipole polygon;

an annular connector; and a pair of baluns connected to each of the plurality of dipoles, a bottom end of each of the pair of baluns being mounted to the annular connector, each of the pair of baluns having an arc shape, each of the plurality of dipoles including a pair of unit arms connected with top ends of the pair of baluns, and the pair of unit arms being aligned with each other;

wherein each unit arm of the pair of unit arms has a first end and a second end, the first ends of the pair of unit arms are deposed adjacent to each other and are mounted on the top end of the corresponding pair of baluns, the second end of one unit arm among the pair of unit arms bends inwards to a center of the dipole polygon so as to form an inward loaded line, the second end of the other unit arm among the pair of unit arms bends downwards to form a downward loaded line, and the adjacent dipoles of the plurality of dipoles have the inward loaded lines parallel to each other at one end and the downward loaded lines parallel to each other at the other end.

2. The wideband dual-polarized radiation element as claimed in claim 1, wherein the downward loaded lines are orthogonal to the dipole polygon, and the inward loaded lines are configured to point substantially to a center of the dipole polygon.

3. The wideband dual-polarized radiation element as claimed in claim 1, comprising two pairs of dipoles that have cross polarization, each pair of the dipoles facing each other to form a shape of octagon or hexadecagon, and a distance between the facing dipoles is 0.4~0.6 of an operating wavelength.

4. The wideband dual-polarized radiation element as claimed in claim 1, wherein each of the plurality of dipoles has a cross-section shape of round, square, "L," "T," stub line or polygon.

5. The wideband dual-polarized radiation element as claimed in claim 1, wherein each of the pair of baluns has a length of 0.2~0.3 of an operation wavelength, and is configured to feed current to the corresponding dipole of the plurality of dipoles in a balanced manner.

6. The wideband dual-polarized radiation element as claimed in claim 5, wherein the height of each of the pair of baluns is at a range of 0.25 of wavelength of a central frequency, and each of the pair of baluns is orthogonally fixed on the annular connector.

7. The wideband dual-polarized radiation element as claimed in claim 5, wherein each of the pair of baluns defines a groove in a lower surface thereof for accommodating a feeding cable; the feeding cable includes a core wire and an outer metallic shielding layer; on the top end of each of the pair of baluns, one side thereof defines a hole, and the other side sets a metallic pillar; one end of the feeding cable extends through the hole, the core wire thereof and the metallic pillar are respectively connected to two ends of a feeding slice, the outer metallic shielding layer of the feeding cable is welded in the groove near the hole, and the other end of the feeding cable is welded to the corresponding balun of the pair of baluns near the annular connector.

8. The wideband dual-polarized radiation element as claimed in claim 7, wherein between the feeding slice and the top of each of the pair of baluns, a pair of dielectric rings sleeve are disposed around the core wire of the feeding cable and the metallic pillar, thereby supporting the feeding slice.

9. The wideband dual-polarized radiation element as claimed in claim 1, wherein the wideband dual-polarized radiation element is made by integral die-casting.

10. A wideband antenna comprising a metal reflector, and at least one wideband dual-polarized radiation element as claimed in claim 1 mounted on the metal reflector.

11. The wideband antenna as claimed in claim 10, wherein the annular connector defines a plurality of fixing holes, and the wideband dual polarized radiation element is fixed on the metal reflector by fasteners engaging with the fixing holes.

12. The wideband antenna as claimed in claim 10, wherein the metal reflector has a vertical sidewall, the wideband dual-polarized radiation element is arranged on the metal reflector, and the downward loaded lines of the plurality of dipoles are positioned near the vertical sidewall of the metal reflector.

13. The wideband antenna as claimed in claim 10, comprising at least two wideband dual-polarized radiation elements installed linearly on the metal reflector, and the adjacent radiation elements each have one of the inward loaded lines arranged adjacent to each other.

14. The wideband antenna as claimed in claim 13, further comprising one or more high band radiation elements mounted on the metal reflector, and at least one of the high band radiation elements is embedded within the wideband dual-polarized radiation element.

* * * * *